US006164727A

United States Patent [19]

Kelly

[11] Patent Number: 6,164,727

[45] Date of Patent: Dec. 26, 2000

[54] METHOD OF MINING A SOLUBLE MINERAL

[76] Inventor: Melvin E. Kelly, 2742 Fair Oaks Cir., Odessa, Tex. 79762

[21] Appl. No.: 09/223,954

[22] Filed: Dec. 31, 1998

[51] Int. Cl.[7] ..... E21B 43/28

[52] U.S. Cl. ..... 299/4; 299/3; 299/5; 166/268; 166/52

[58] Field of Search ..... 299/3, 4, 5; 166/268, 166/52, 105, 67, 68

[56] References Cited

U.S. PATENT DOCUMENTS

| | | | |
|---|---|---|---|
| 1,612,611 | 1/1926 | Claytor | 299/5 |
| 3,155,177 | 11/1964 | Fly | 175/67 |
| 3,278,233 | 10/1966 | Hurd et al. | 299/4 |
| 3,652,129 | 3/1972 | Edmonds | 299/4 |
| 3,713,698 | 1/1973 | Rhoades | 299/4 |
| 3,816,027 | 6/1974 | Miscovich | 417/184 |
| 3,951,457 | 4/1976 | Redford | 299/5 |
| 4,035,023 | 7/1977 | Cockrell | 299/17 |
| 4,074,779 | 2/1978 | Cheung et al. | 175/314 |
| 4,077,671 | 3/1978 | Bunnelle | 299/17 |
| 4,140,346 | 2/1979 | Barthel | 299/17 |
| 4,211,613 | 7/1980 | Meckler | 203/11 |
| 4,214,628 | 7/1980 | Botts | 166/90.1 |
| 4,241,953 | 12/1980 | Bradford et al. | 299/4 |
| 4,302,052 | 11/1981 | Fischer | 299/67 |
| 4,346,936 | 8/1982 | Yan | 299/4 |
| 4,348,058 | 9/1982 | Coakley et al. | 299/17 |
| 4,358,157 | 11/1982 | Showalter | 299/4 |
| 4,452,490 | 6/1984 | Yan | 299/4 |
| 4,575,154 | 3/1986 | Mays | 299/4 |
| 4,815,791 | 3/1989 | Schmidt et al. | 299/4 |
| 4,869,555 | 9/1989 | Peters et al. | 299/7 |
| 4,988,389 | 1/1991 | Adamache et al. | 166/302 |
| 5,472,054 | 12/1995 | Hinds | 166/373 |
| 5,685,374 | 11/1997 | Schmidt et al. | 166/369 |
| 5,720,598 | 2/1998 | de Chizzelle | 417/53 |

*Primary Examiner*—Eileen D. Lillis
*Assistant Examiner*—John Kreck
*Attorney, Agent, or Firm*—Head Johnson & Kachigian

[57] ABSTRACT

For use in a field having a plurality of interspersed injection and production wells that extend to a mineral bearing formation, a system for extracting the mineral from the formation having a jet pump system for each production well, each pump system having a power fluid inlet and a production fluid outlet at the earth's surface, a bottom hole fluid inlet, a solvent reservoir at the earth's surface providing a source of liquid solvent and reservoir having connection to each of the injection wells by which solvent is conveyed to the mineral producing formation to produce a bottom hole reservoir of mineral laden bottom hole fluid, a power fluid reservoir at the earth's surface, a high pressure pump at the earth's surface connected between the power fluid reservoir and the power fluid inlet of each of the jet pump systems for moving power fluid through the jet pump systems to draw in bottom hole fluid that is mixed with the power fluid to provide production fluid that is moved to the earth's surface; and a mineral extraction station at the earth's surface that receives the production fluid and by which mineral is extracted and that provides recycled fluid that is conveyed to the power fluid reservoir.

8 Claims, 5 Drawing Sheets

METHOD OF MINING A SOLUBLE MINERAL

CROSS-REFERENCE TO RELATED APPLICATIONS

This application is not related to any pending United States or foreign patent application, nor is it referenced in any microfiche appendix.

BACKGROUND OF THE INVENTION

1. Field of the Invention

Minerals are extracted from the earth in a variety of ways, determined to a great extent by the physical state in which the minerals naturally occur. Petroleum is always extracted by wells drilled into the earth. In formations that have sufficient naturally occurring underground pressure, the petroleum flows to the earth's surface, but if the formation pressure is insufficient to cause the petroleum to flow to the surface, it is pumped to the surface. Natural gas is recovered by wells penetrating a gas bearing formation with the pressure of the gas causing it to flow to the earth's surface.

On the other hand, minerals that naturally occur in a solid state are more difficult to remove. Coal and most metal bearing ores are commonly removed by mines dug from the earth's surface into the producing formation. Coal or metal bearing ores are removed as solids and, after being removed from a mine, are conveyed by trucks or conveyor belts to a processing plant. Solid mineral bearing ores are also removed by surface mining, that is, by digging strip pits in which the overburden is removed and thereafter the mineral bearing ore is physically removed. Some types of ores are removed by large open pit mines dug in the form of a large crater with circumferential shelves circling the mine core by which equipment is moved into the mine and by which ore is removed from it.

In some cases, minerals that occur naturally as a solid can be removed by wells rather than removing the solid ore from the earth. This technique is called solution mining. The present invention is concerned with an improved system, and method of use thereof, for solution mining.

2. Prior Art

Ore can be extracted through wells even when the ore is not in situ a naturally occurring liquid or gas. As an example, U.S. Pat. No. 4,869,555, entitled "Apparatus for Recovery of Sulphur" discloses in detail a system for recovering sulphur from an underground formation in which a solvent, in this case hot water, is injected into the formation to produce a sulphur solution that is then conveyed to the earth's surface where the sulphur content is recovered. Others have extracted viscous petroleum from subterranean formations by heating the viscous hydrocarbon products by the injection of steam or hot water to raise the viscosity sufficient to allow the hydrocarbon products to be pumped to the earth's surface. An example of such a system for mining viscous petroleum is revealed in U.S. Pat. No. 3,951,457 entitled "Hydraulic Mining Technique for Recovering Bitumen from Tar Sand Deposit."

An additional technique for extracting minerals hydraulically is disclosed in U.S. Pat. No. 4,074,779 entitled "Backwashing System for Slurry Pick-up Used in Hydraulic Borehole Mining Devices." This patent teaches a system wherein high pressure water jets are used to cut mineral to be mined to form a slurry that is then picked up and conveyed to the earth's surface. In this system, the mined minerals remain as small size solids that are conveyed in a slurry.

These previously issued United States patents and the references cited in them form a good background for the present invention.

In addition to the patents above discussed, other prior art that provides additional background information to the subject matter of the present invention may be found in the following United States patents:

| PATENT NO. | INVENTOR |
|---|---|
| 3,155,177 | Fly |
| 3,278,233 | Hurd et al. |
| 3,652,129 | Edmonds |
| 3,713,698 | Rhoades |
| 3,816,027 | Miscovich |
| 3,951,457 | Redford |
| 4,035,023 | Cockrell |
| 4,074,779 | Cheung et al. |
| 4,077,671 | Bunnelle |
| 4,140,346 | Barthel |
| 4,241,953 | Bradford et al. |
| 4,302,052 | Fischer |
| 4,346,936 | Yan |
| 4,348,058 | Coakley et al |
| 4,358,157 | Showalter |
| 4,452,490 | Yan |
| 4,869,555 | Peters et al. |
| 5,685,374 | Schmidt et al. |

SUMMARY OF THE INVENTION

The invention disclosed herein is a method of mining a soluble mineral and a system for use in practicing the method. The method includes the steps of drilling a plurality of spaced apart injection wells in the earth that communicate with the mineral producing formation. While method and system of this invention can be practiced on flat earth where no previous mineral extraction has been attempted it can also be employed to augment the extraction of minerals from an open pit mine in which a portion of the available mineral has been already physically removed to form an open pit. The invention will be illustrated and described as used to recover mineral from an open pit mine in which the mine has been created by circumferential terraces that extend from the earth's surface into the bottom of the pit.

After drilling a plurality of spaced apart injection wells in the earth (or simultaneously therewith) a plurality of interspersed production wells are drilled into the same mineral bearing formation. A jet pump system is installed in each of the production wells. The jet pump system for each well has a power fluid inlet and a production fluid outlet at the earth's surface and a bottom hole fluid inlet.

Solvent in liquid form is piped into each of the injection wells to contact the mineral producing formation, the solvent serving to dissolve mineral from the formation to provide a subterranean reservoir of bottom hole fluid. The type of solvent is determined by the mineral being extracted and the characteristic of the formation in which the mineral is obtained. For instance, the solvent can be in the form of water where the mineral is soluble in water, such as for extracting sulphur. On the other hand, if the mineral is a metal that is not soluble in water, then an acid solution is typically employed. If the mineral to be solution mined is copper, the solvent can be sulfuric acid.

Injection of a solvent into the mineral bearing formation may employ the application of pressure, that is the solvent may be injected into the injection wells under pressure applied by a pump located at the earth's surface, or in other instances, the solvent may be injected into the formation at atmospheric pressure wherein the hydrostatic head of the solvent in the injection wells is sufficient to cause the solvent to disperse in the producing formation to dissolve mineral from the formation. When the system of this invention is employed to solution mine mineral from an open pit type mine in some of the injection wells will be at lower elevations in the lower portion of the open pit mine so that substantial hydrostatic pressure is created in the injection wells without the application of pump pressure at the earth's surface. In any event, according to the circumstances, the depth of the mineral, and so forth, the solvent is injected either under pressure, or by atmospheric pressure into the producing formation where it contacts the mineral to be mined to dissolve at least a portion of the mineral to form a mineral bearing solution, such mineral bearing solution being termed a "bottom hole fluid."

The bottom hole fluid formed by the injected solvent and the recoverable mineral migrates to the area of the lower portion of the production wells and to the bottom hole fluid inlet of each of the jet pump systems in the production wells.

A power fluid is pumped under pressure down the power fluid inlet of each of the jet pump systems of each of the production wells. The power fluid passes through a jet nozzle in the bottom of each of the production wells into a pump throat where venturi action draws bottom hole fluid into the pump that is mixed with the power fluid to form production fluid. The production fluid is conveyed by the force of the jet pump action to the earth's surface.

At the earth's surface the production fluid is treated to extract at least a portion of the mineral content leaving a recycle fluid. The recycle fluid is typically passed through a fluid cleaner, such as a hydrocyclone, where solids are extracted and the cleaned recycle fluid is then conveyed to a power fluid reservoir. The power fluid injected into each of the production wells is obtained from this power fluid reservoir.

The injection wells may be of two basic types. One type uses a single string of tubing extending from the earth's surface to the jet pump at the bottom with the production fluid flowing to the earth's surface in the annular area within the well and exterior to the tubing. The other type of pump systems employs two parallel strings of tubing extending within the well, the first of the strings serving to convey the power fluid down the well to pass through a jet nozzle and the production fluid is conveyed to the earth's surface through the second tubing string, rather than through the well annulus. Each pump system has its advantage and the type of pump system selected depends upon the characteristics of the particular mineral being mined, the volume of power fluid and production fluid handled by each of the injection wells and the depth of the production wells.

In the system to be described herein power fluid, production fluid and recycled fluid move in a circuitous path. Liquid solvent conveyed by the injection wells into the underground formation provide the bottom hole fluid. By the use of jet pumps the efficiency and effectiveness of solution mining is substantially increased compared to the use of mechanical down hole pumps as has been customarily employed.

Known solution mining systems typically employ centrifugal bottom hole pumps to raise production fluid to the earth's surface. Centrifugal pumps are initially expensive and are relatively expensive to repair and maintain and are typically a major cost in solution mining. The system herein achieves improved economy by the use of down hole jet pump systems that are relatively low maintenance and replacement costs. Further, the method and system of this invention provides an improved flow path arrangement that makes effective use of the fluids that are moved in a circular pattern through the system to improve the efficiency and effectiveness of extracting a soluble mineral from subsurface formations.

A better and more complete understanding of the invention will be obtained from the following description of the preferred embodiments taken in conjunction with the attached drawing.

BRIEF DESCRIPTION OF THE DRAWINGS

In FIG. 3 only three injection wells and three production wells are shown in a representative pattern, it being understood that in the typical application of the invention many more injection and production wells are employed in the total pattern used to extract mineral from an underground formation.

DETAILED DESCRIPTION OF THE PREFERRED EMBODIMENTS

Figure 1:
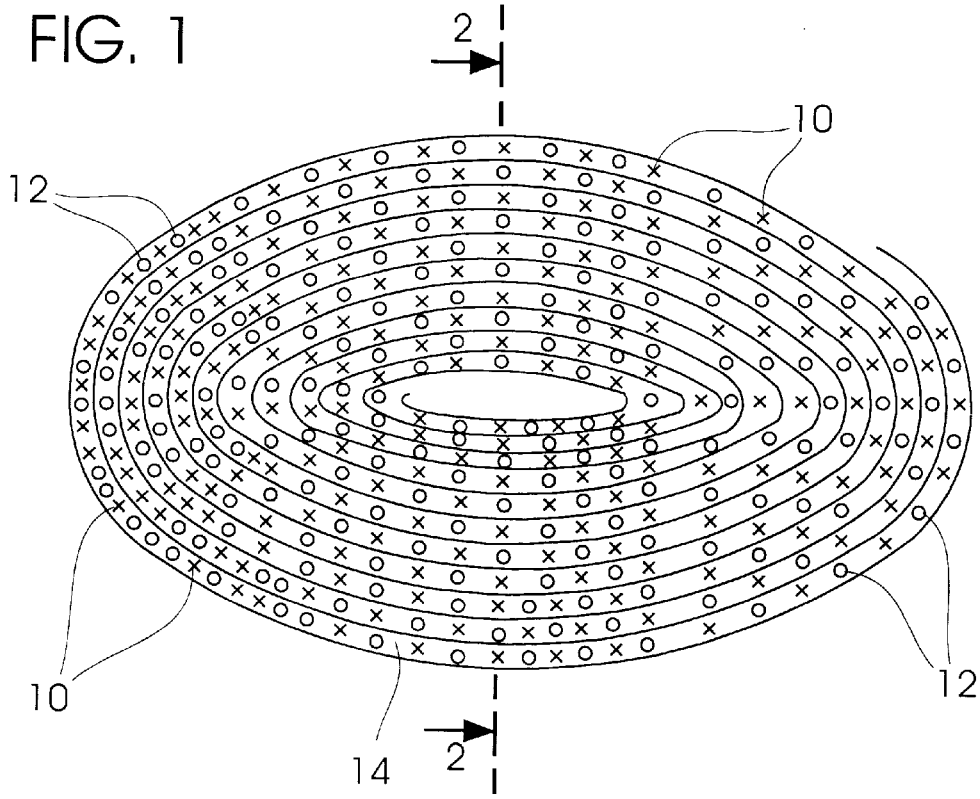
FIG. 1 is a top plan view, shown diagrammatically, of an open pit mine having circumferential shelves formed as the mine has progressed into the earth's surface and showing a pattern of injection wells and production wells that are drilled into the mineral bearing formation in a preferred pattern as used in practicing this invention.
Figure 2:
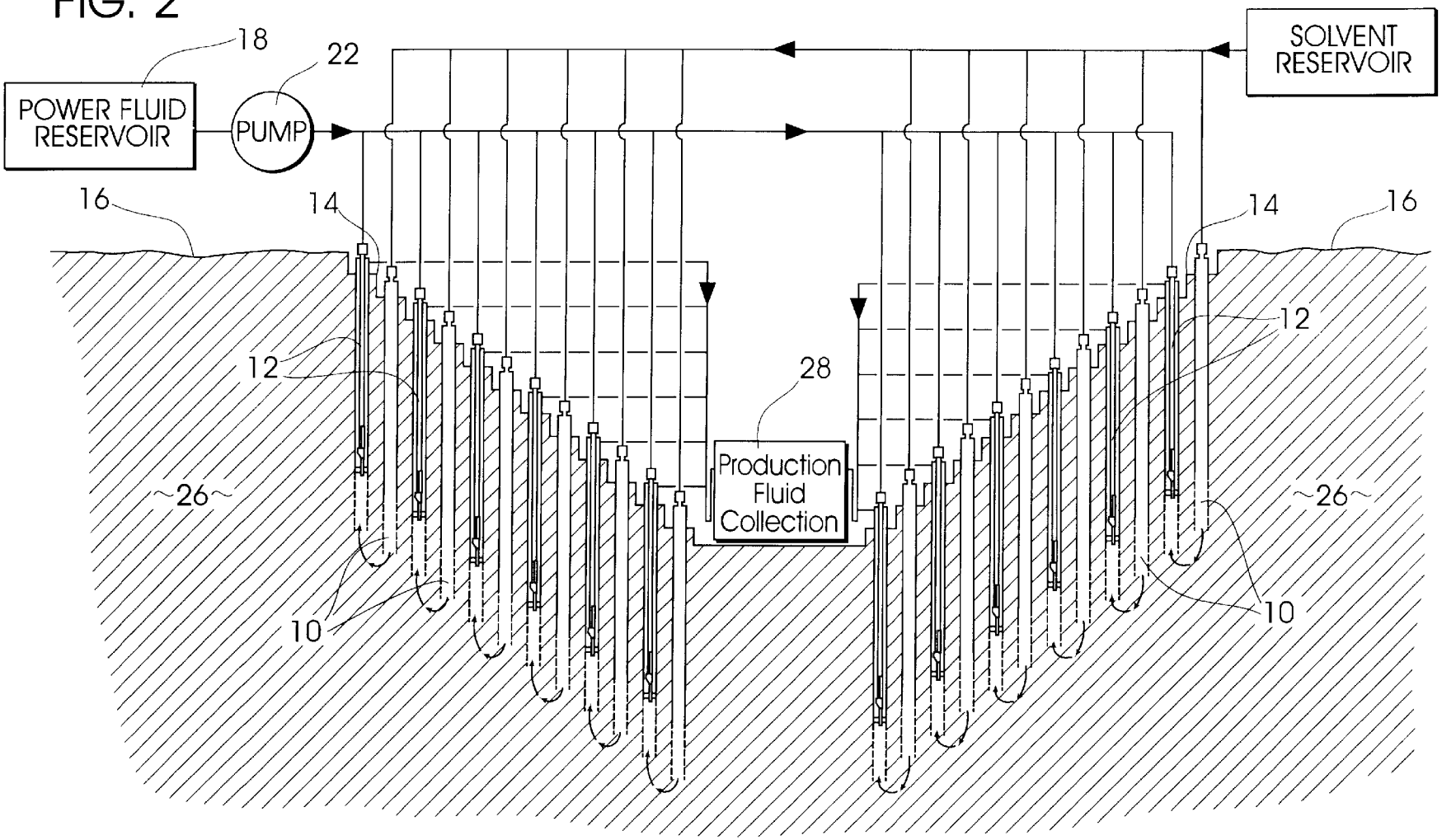
FIG. 2 is an elevational cross-sectional view of the earth taken along the lines 2—2 of FIG. 1 showing the relationship of injection wells and production wells.

FIGS. 1 and 2 show the general environment in which the invention may be practiced. FIG. 1 is a plan view of a typical pit mine in which the mine has been dug by way of circumferential shelves or benches usually formed in a spiral pattern from the earth's normal surface down to the bottom of the pit. Pit mines are employed where a valuable mineral, such as copper or other kinds of metallic ore, is available in a large formation near the earth's surface. Open pit mines permit the removal of large quantities of ore bearing material that can be hauled out of the mine in large trucks or by the use of endless belt conveyers. The plan view of the pit mine of FIG. 1 may encompass an area of as much as a mile in length is typically either circular or elliptical as shown. When a pit mine is completed to the point as shown in FIG. 1, that is where the benches have extended to a small reduced area bottom surface, further extraction of ore is more difficult and provides an ideal location for the practice of this invention wherein much of the mineral bearing ore has, of necessity, been bypassed due to the geometrical configuration required of the mine. An open pit mine forms an ideal location for the application of the invention herein but is by no means the only environment in which the invention can be employed. On the contrary, the invention herein may be employed for extraction of soluble mineral from an underground formation where no previous mining of any kind has been attempted.

A first step in practicing the method of this invention is to drill a plurality of spaced apart injection wells in the earth that communicate with a mineral producing formation. In FIG. 1, injection wells are indicated by an "X" and by the numeral 10. Interspersed with the injection wells are production wells indicated by a "0" and by the numeral 12. The injection wells 10 and production wells 12 are interspersed but this does not require that the number of injection wells must equal the number of production wells or that the wells be drilled in a strict alternate pattern. In some instances, as seen in FIG. 1, injection wells may be placed adjacent each other and in some instances production wells may also be placed adjacent each other. The only requirement is that the injection and production wells should be interspersed with each other. When the invention is practiced in an open pit mine as shown in FIG. 1, use may be made of the circumferential benches 14 that are commonly formed in the normal process of pit mining. These benches are usually formed in a spiral pattern and provides a road surface for conveying equipment into the mine and, more importantly, for hauling produced ore out of the mine.

FIG. 2 is a cross-sectional view of an open pit mine as shown in FIG. 1. FIG. 2 shows the normal earth's surface identified by the numeral 16. The pit is formed down from the earth's surface providing benches 14 on which the injection and production wells 10 and 12 are drilled. Located on the earth's surface is a power fluid reservoir 18 and a solvent reservoir 20. Reservoir 18 stores power fluid used to raise production fluid from the subterranean formation, the power fluid being supplied through pump 22 to each of the production wells 12.

A liquid solvent solution is maintained in solvent reservoir 24 and is supplied to each of the injection wells 10. In some instances, such as in a pit mine as shown in FIGS. 1 and 2, the solvent may be injected directly into the producing formation by the force of gravity alone, that is without the use of a pressure pump. In other instances a pump will be required between solvent reservoir 24 and the injection wells 10 to cause the solvent to flow into the mineral bearing formation.

When solvent is conveyed from reservoir 24 into the injection wells 10, it flows out the lower end of each of the wells and into mineral bearing formation generally indicated by the numeral 26 to dissolve the desired mineral. For instance, if the invention is being used to extract copper, a solvent is required that will dissolve the copper content of a mineral bearing formation and for this purpose, sulfuric acid can function as the solvent, and in such case, solvent reservoir 24 contains a sulfuric acid solution.

As the solvent enters the mineral bearing formation 26 and reacts with or in effect "dissolves" the mineral being mined, a solution is created that is referred to as "bottom hole fluid" that surrounds the bottom of each of production wells 12. This bottom hole fluid is extracted from the producing formation by production wells 12 in a manner that will be described in detail subsequently. The bottom hole fluid is, in production wells 12, mixed with power fluid from reservoir 18, the mixture of the power fluid and bottom hole fluid producing "production fluid" that is conveyed to a production fluid collection reservoir 28. In an open pit mine, the production fluid collection reservoir may be at the lowest point in the mine, as shown in FIG. 2. From the production fluid collection reservoir 28, the production fluid can then be pumped to the earth's surface for processing by which the mineral is extracted from the production fluid.

Figure 3:
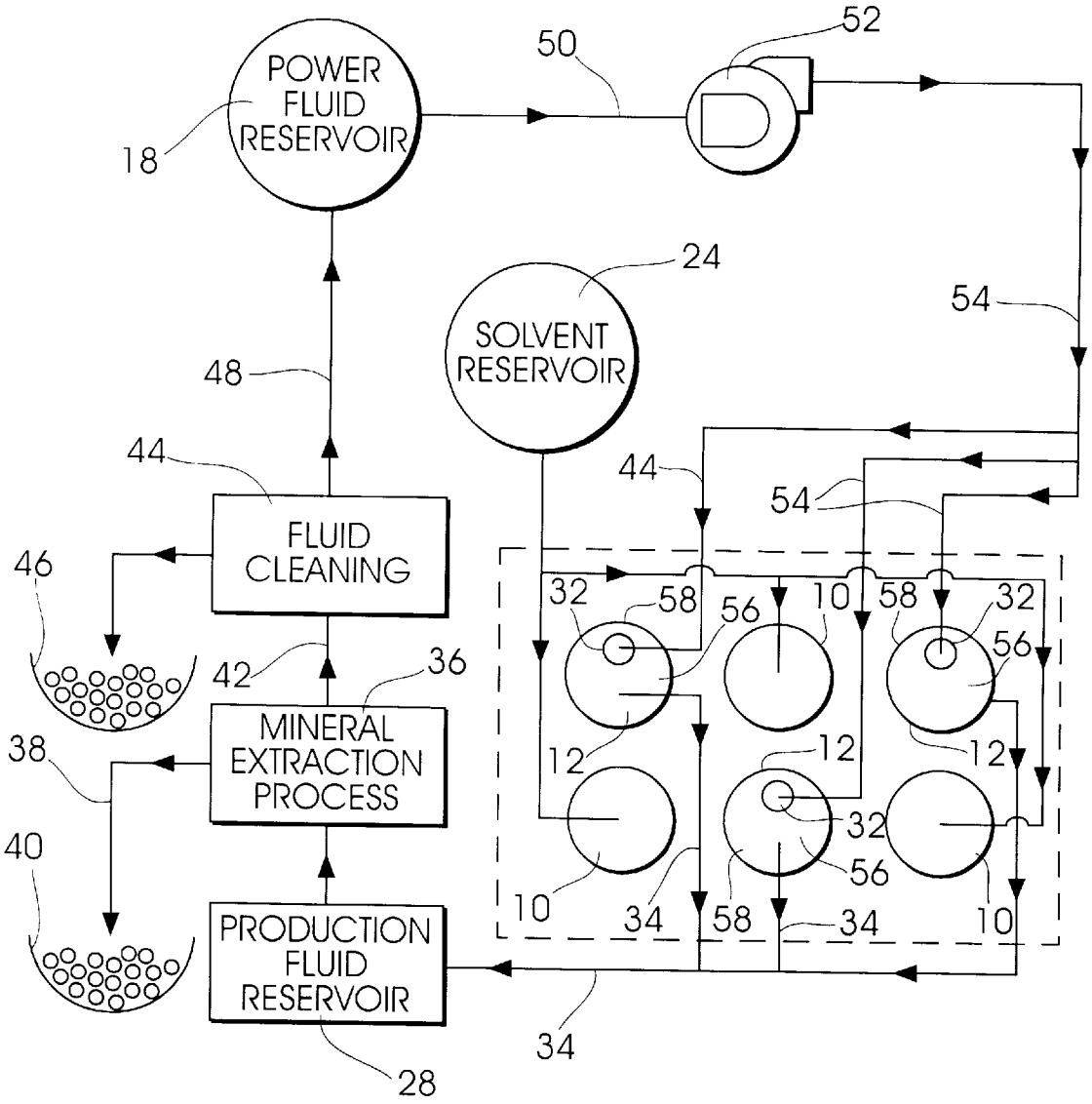
FIG. 3 is a flow diagram of the system of this invention.

FIG. 3 is a flow diagram of the system and method for practicing the invention. In FIG. 3, only three injection wells 10 are shown along with three production wells 12. The injection and production wells are arranged in a pattern that is representative of a much larger number of injection and production wells in a much larger pattern in a typical mining operation. Solvent for reacting with the mineral being mined is contained in solvent reservoir 24 and is connected by piping to each of the injection wells 10. As previously stated, the solvent may be injected directly into the producing formation through injection wells 10 in some instances without requiring supplemental pressure, that is the force of gravity, and this is particularly true in an open pit mine application as shown in FIGS. 1 and 2. In other instances, a pump will be required between solvent reservoir 24 and injection wells 10. Further, although not shown in FIG. 3, solvent makeup will be required in the process in which solvent is added as needed to solvent reservoir 24.

The flow of solvent down through injection wells 10 results in the creation of bottom hole fluid in the producing formation in the area surrounding the bottom of the injection and production wells, the area containing the bottom hole fluid being indicated in dotted outline and identified by the numeral 30. When power fluid is injected down through tubing 32 in each of injection wells 12, the venturi effect of the jet pump at the bottom of each of the wells draws in bottom hole fluid 30. The combined power fluid and bottom hole fluid is caused to flow back up the annular area within the production wells as production fluid, the production fluid being withdrawn through conduits 34.

The production fluid flows into production fluid collection reservoir 28. If the system is carried out to produce mineral from a previously unmined site in which there is no open pit area and mining takes place essentially on the naturally occurring earth's surface, then production fluid reservoir 28 would be located on the earth's surface along with power fluid reservoir 18 and solvent reservoir 24.

The production fluid passes from reservoir 28 to a mineral extraction process 36 where at least a portion of the dissolved mineral is removed, the recovered mineral passing by conduit 38 to an extracted mineral collection area 40. The particular mineral extraction process 36 is not a part of this invention. The extraction process varies significantly according to the particular mineral being mined. For instance, if the mineral is sulphur, the recovery of the sulphur from a sulphur water solution consists essentially of evaporating away the water. Other types of minerals require different types of solvents and require different types of recovery processes. Such processes are well known in the industry to metallurgical processing and mining engineers.

After passing through mineral extraction process 36, the production fluid becomes recycled fluid and flows through conduit 42. The term "recycled fluid" refers to production fluid after at least a significant portion of the dissolved mineral has been removed. The recycled fluid appearing in conduit 42 is essentially the production fluid as it appears in conduit 34 with a portion of the mineral content extracted. This recycled fluid is conveyed by conduit 42 to a fluid cleaning station 44 it is cleaned of solids and other harmful constituents. This invention is not concerned with a specific or particular type of cleaning system 44, however, as an example, the fluid cleaning station 44 may be a hydrocyclone for extracting the solid components. Extracted materials from the cleaning process, such as solids, is deposited in a collection container 46 for disposal such as in a land fill or in other ecologically acceptable ways. The recycled fluid, having been cleaned at cleaning station 46, passes by way of conduit 48 to power fluid reservoir 18. Thus, the system employs a recirculation pattern so that large mining fluid is not discharged to the environment. Makeup fluid, such as water, may be added back into the power fluid reservoir 18 to maintain a selected reservoir level so that only fluid lost in the mineral extraction process 36 or in cleaning process 54 needs to be replaced. The system may be practiced in a way so that the only required fluid addition to the system is to solvent reservoir 24.

From reservoir 18 the power fluid flows by conduit 50 to a pump 52 and out of the pump by way of conduit 54 to the input tubing 32 of each of the production wells. Pump 52 is preferably a positive displacement pump such as a multiplex piston pump.

FIG. 3 shows the use of production wells having a casing with a single tubing string 32 extending from the earth's surface to the bottom hole jet pump. Production fluid that is lifted from the bottom of the well to the surface flowing upwardly in the annular area 56 within the well casing and exterior of tubing 32. In another embodiment, instead of the production fluid flowing up in annular area 56, a production tubing is used in parallel with tubing 32 so that two strings of tubing extend from the surface down to the jet pump and the production fluid flows to the surface through production tubing.

Figure 4:
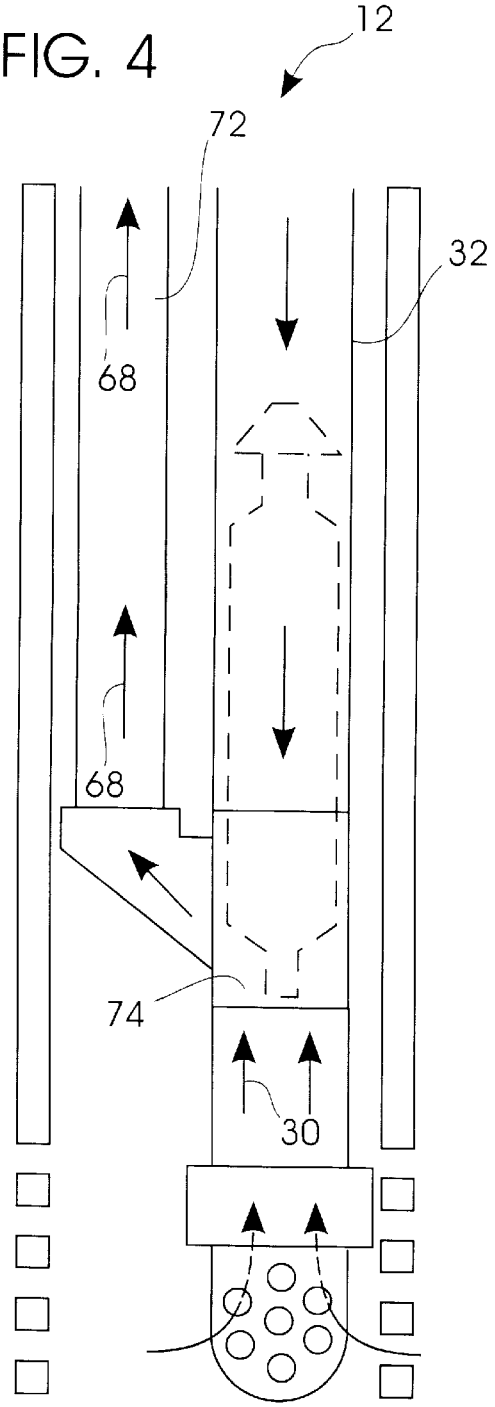
FIG. 4 is a diagrammatic view of the use of a jet pump in the lower portion of a production well in the arrangement wherein the power fluid is pumped down a string of tubing within the well and through a jet pump to mix with bottom hole fluid to provide production fluid that flows by the action of the pump back to the earth's surface in the annular area within the well casing.
Figure 5:
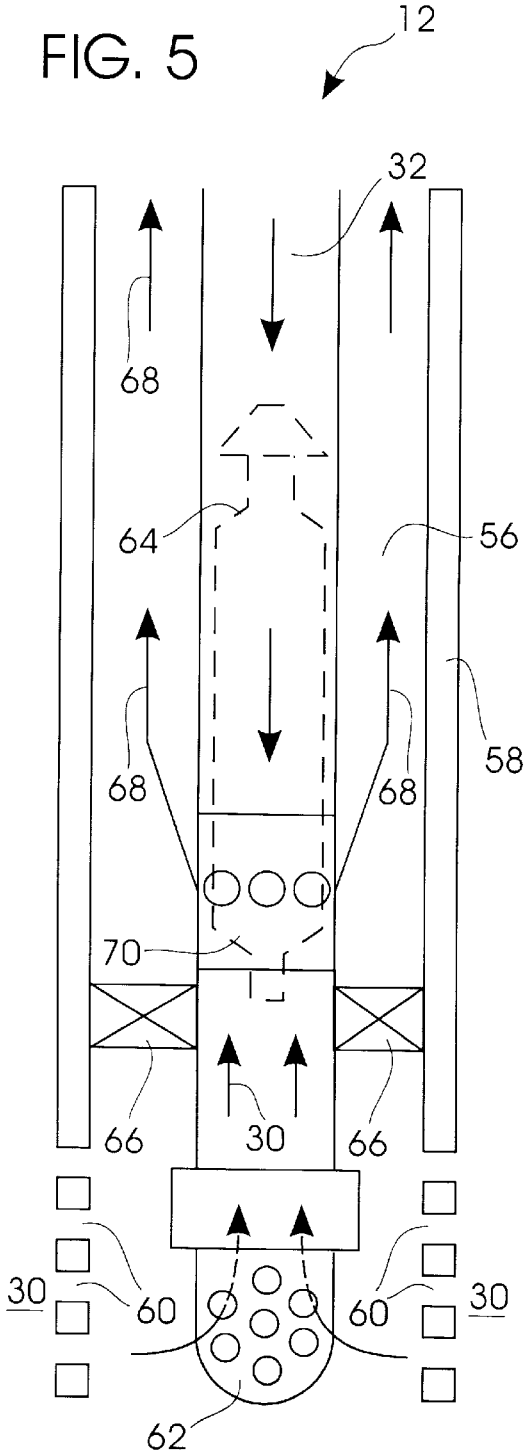
FIG. 5 is a diagrammatic view of the lower portion of an injection well that employs two strings of tubing, that is, a first string through which power fluid is pumped down through a jet pump to mix with bottom hole fluid and the resultant production fluid is moved back to the earth's surface through a separate and parallel tubing string.

Whether a single string of tubing 32 as illustrated in FIG. 3 is employed or a double string is dependent upon the type of down hole jet pump and this difference is illustrated in FIGS. 4 and 5. FIG. 4 is a diagrammatic illustration of a jet pump system in which a production well, generally indicated by numeral 12, includes a casing 58 that extends from the earth's surface into the producing formation. Casing 58 is typically perforated at 60. Bottom hole fluid from bottom bole production fluid area 30 flows into casing 58 through perforations 60. On the bottom of tubing 32 is a perforated closure 62, sometimes referred to as a strainer, through which the bottom hole production fluid 30 can flow upwardly into the bottom of the pump. Power fluid 50 is pumped downwardly through tubing 32 and through a jet pump generally indicated by the numeral 64 where the power fluid flows through an orifice and into a venturi throat. In the orifice the cross-sectional area of the fluid flow is dramatically reduced and as the fluid passes from the reduced orifice into the throat of the pump (not shown in the drawings) the drop in pressure that results draws production fluid 30 upwardly through perforated closure 62 and into the pump above a packer 66. Within the pump power fluid is mixed with the bottom hole production fluid to form production fluid 68 that flows to the earth's surface and is carried away by conduit 34 as seen in FIG. 3.

The pump system illustrated diagrammatically in FIG. 4 typically includes a jet pump 64 that can be installed and removed by fluid flow, that is jet pump 64 does not require any apparatus attached to it extending to the earth's surface. When it is necessary to remove the jet pump to repair the jet nozzle, the venturi portion or so forth, the jet pump assembly 64 can be returned to the earth's surface by reversing the flow of fluid, that is by pumping fluid into annular area 56, the fluid entering through orifices 70 in the lower portion of tubing 50 above packer 66 to hydraulically force jet pump 64 back to the surface where it can be retrieved for repair or replacement.

FIG. 5 is a diagrammatic illustration of a jet pump system that functions essentially the same as has been described with reference to FIG. 4 except that in FIG. 5 the pump system includes a production fluid conduit 72 that connects with a bottom hole assembly 74. Power fluid is pumped down through tubing 32 where the jet action draws in bottom hole production fluid 30 that is mixed with the power fluid to form production fluid 68 that flows upwardly to the earth's surface through production fluid conduit 72. Thus, the only significant difference between the arrangement of FIGS. 4 and 5 is the type of bottom hole assembly used in FIG. 4 versus that of FIG. 5 and the inclusion of production fluid tubing 72 in FIG. 5. Whether the single tubing system of FIG. 4 or the double tubing system of FIG. 5 is employed, the overall concept of the invention as disclosed in the flow diagram of FIG. 3 remains the same.

Figure 6:
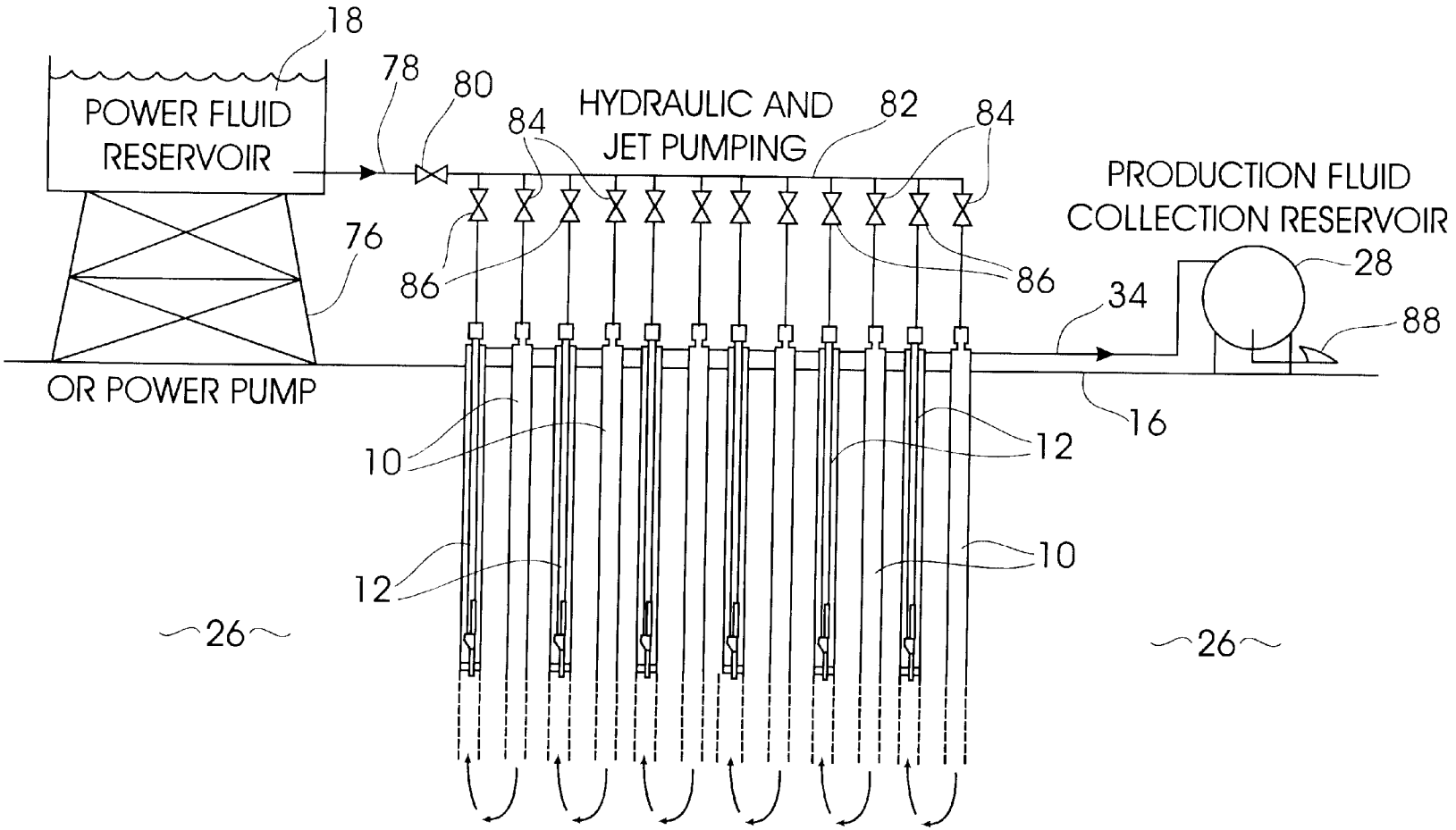
FIG. 6 is an elevational cross-sectional view of the earth showing the system of this invention practiced in an area where the earth's surface is level, or essentially level, as compared with the application of the invention in an open pit mine as has been illustrated in FIG. 2.

The system for extracting soluble minerals from the earth can be practiced other than in an open pit as illustrated in FIG. 2 such as in an area where the surface of the earth is flat or relatively flat. One method of employing the invention when the earth is relatively flat is seen in FIG. 6. The surface of the earth is indicated by 16. A cross-section of a pattern of injection wells 10 and interspersed production wells 12 is shown. Power fluid reservoir 18 is shown mounted on a platform 76 however it could be mounted on the earth's surface 16. When mounted on an elevated platform increase hydrostatic pressure of power fluid is applied to injection wells 10 as well as to production wells 12.

A conduit 78 conveys fluid from reservoir 18 through a master valve 80 to a manifold conduit 82 connected to manifold conduit 82 are a number of valves, some of which connect manifold conduit 82 to injection wells 10 and others that connect the manifold conduit to production wells 12. When valves 84 are opened fluid from reservoir 18 is communicated to injection wells 10, allowing the fluid to flow into the mineral bearing formation 26 where solvent content of the power fluid dissolves or leaches away the mineral. After injecting fluid having a solvent or leaching agent therein into the producing formation 26 through injection wells 10, valves 84 may be closed and then valves 86 opened. Power fluid flowing through valves 86 into production wells 12 raises production fluid from mineral bearing formation 26 to the earth's surface, the production fluid flowing through gathering manifold 34 to production fluid collection reservoir 28.

In FIG. 6 a pump is not illustrated however if increased fluid flow rates are required a pump can be inserted between power fluid reservoir 18 and conduit manifold 82 in the same position and for the same purpose as pump 22 in FIG. 2.

The overall system for extracting soluble mineral from the earth employing the arrangement of FIG. 6 can typically utilize the flow diagram of the system of FIG. 3. FIG. 6 does not show a solvent reservoir as does FIG. 3. The reason is a separate solvent reservoir is not required in practicing the invention. The solvent necessary for dissolving or leaching away the minerals to be produced may be added directly to the power fluid reservoir 18.

Production fluid flows through gathering manifold 34 into production fluid collection reservoir 28 as previously described. Production fluid flows from reservoir 28 through a conduit 88 typically to a mineral extraction process, such as mineral extraction process 36 of FIG. 3.

FIG. 6 shows manifold 82 connected through valves 84 and 86 to both injection wells and production wells however the system of FIG. 6 could be practiced as in the flow chart of FIG. 3, that is where the injection wells are connected to a solvent reservoir and the production wells connected to the power fluid reservoir 18 and in which case the solvent reservoir may be fed by gravity which could be augmented by mounting the reservoir elevationally above the earth's surface while the production wells could be fed from a power fluid reservoir augmented by pump pressure.

The system of this invention for mining soluble minerals is significantly different than the standard techniques employed in the mining industry. The improvements of the system disclosed herein can be attributed to the unique adaptation of the advantages of down hole jet pumps as a means of extracting fluid from an underground formation and passing it to the earth's surface. The typical solution mining system in use today employs production wells that use mechanical pumps, in some cases reciprocating pumps but in more cases down hole centrifugal pumps. Positive replacement down hole pumps require a reciprocating sucker rod string to extend from the earth's surface with a great deal of mechanical equipment necessary to reciprocate the sucker rod string and the down hole pump is subject to significant wear. The use of a down hole centrifugal pump requires electrical energy to be conducted down into the bottom of the well. Centrifugal pumps work successfully to produce large fluid flow rates but are subject to mechanical wear and failure. Centrifugal pumps require precision seals to separate the pump rotor from the motor and if leakage occurs the motor will quickly fail. On the other hand, the system of this invention eliminates the need to convey electrical power from the earth's surface down to the bottom of each of the production wells. The system herein does not require the application of either mechanical or electrical energy at the bottom of the production wells. Instead, power fluid is pumped under pressure down into the wells to mix with bottom hole fluid that is moved to the earth's surface as production fluid. No moving parts are required in the pump system.

Further, an important advantage of the invention as described herein is the arrangement for recirculating fluid wherein the recirculated fluid functions to provide lifting energy necessary to raise bottom hole fluid to the earth's surface. The power fluid that supplies the energy for lifting fluid is mixed with the bottom hole fluid that results from the action of solvent on the mineral to be extracted to provide production fluid in a continuously recycled process so that there is no problem of disposing of large quantities of produced fluid as is the case with other systems.

Jet pump systems that can be employed in practicing the invention are commercially available such as from Oilwell Hydraulics, Inc. located in Odessa, Tex., U.S.A.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein; the more specific meaning is meant.

Whereas, the present invention has been described in relation to the drawings attached hereto, it should be understood that other and further modifications, apart from those shown or suggested herein, may be made within the spirit and scope of this invention.

What is claimed is:

1. A method of mining a soluble mineral that employs a solvent reservoir and a separate power fluid reservoir at the earth's surface comprising the steps of:

(a) drilling a plurality of spaced apart injection wells in the earth that communicate with a mineral producing formation;

(b) drilling a plurality of production wells into the earth that are interspaced with said injection wells and that communicate with said mineral producing formation;

(c) installing a jet pump system in each of said production wells, each jet pump system having a power fluid inlet and a production fluid outlet at the earths surface and a bottom hole fluid inlet;

(d) injecting a solvent in liquid form from said solvent reservoir into said injection wells to contact said mineral producing formation, the solvent serving to dissolve mineral from the formation to provide a reservoir of bottom hole fluid, said jet pump bottom hole fluid inlet being in communication with the bottom hole fluid;

(e) for each said jet pump system, pumping power fluid from said power fluid reservoir down said power fluid inlet through a pump jet nozzle into a pump throat where venturi action draws bottom hole fluid into the pump that is mixed with said power fluid to form production fluid that flows outwardly of said production fluid outlet at the earths surface;

(f) at the earth's surface, extracting at least a portion of said mineral from said production fluid leaving a recycled fluid;

(g) conveying said recycled fluid to said power fluid reservoir ready for use in step (e) and;

(h) continuously repeating steps (d) through (g).

2. A method according to claim 1 including the step of cleaning the recycled fluid of solids before it is conveyed to said power fluid reservoir.

3. A method according to claim 1 wherein step (e) is accomplished using a multiplex positive displacement pump.

4. A method according to claim 1 wherein in step (d) said solvent is injected into said injection wells by gravity.

5. A method according to claim 1 wherein said mineral is one of copper, sulphur, and uranium.

6. A method according to claim 1 wherein said solvent is sulfuric acid.

7. A method according to claim 1 wherein said power fluid is a solution containing at least some of said solvent.

8. A method of mining a soluble mineral according to claim 1 wherein at least one of said jet pump systems includes a jet pump that can be installed and removed by fluid flow.

* * * * *